US008084093B2

(12) United States Patent
Tanaka et al.

(10) Patent No.: US 8,084,093 B2
(45) Date of Patent: Dec. 27, 2011

(54) PROCESS FOR PRODUCING NANO-DEVICE USING POTENTIAL SINGULAR POINTS ON SUBSTRATE

(75) Inventors: Shukichi Tanaka, Koganei (JP); Hitoshi Suzuki, Koganei (JP); Toshiya Kamikado, Koganei (JP); Shinro Mashiko, Koganei (JP)

(73) Assignee: National Institute of Information and Communications Technology Incorporated Adminstrative Agency, Tokyo (JP)

( * ) Notice: Subject to any disclaimer, the term of this patent is extended or adjusted under 35 U.S.C. 154(b) by 890 days.

(21) Appl. No.: 10/886,056

(22) Filed: Jul. 8, 2004

(65) Prior Publication Data

US 2005/0023140 A1 Feb. 3, 2005

(30) Foreign Application Priority Data

Jul. 9, 2003 (JP) ..... 2003-372567

(51) Int. Cl.
*B05D 3/04* (2006.01)

(52) U.S. Cl. ..... 427/301; 977/888; 977/896

(58) Field of Classification Search ..... 427/301; 977/888, 896
See application file for complete search history.

(56) References Cited

U.S. PATENT DOCUMENTS 5,472,881 A * 12/1995 Beebe et al. ..... 436/94
6,398,940 B1 * 6/2002 Chi et al. ..... 205/640
6,541,071 B1 * 4/2003 Bookbinder et al. ..... 427/407.2

OTHER PUBLICATIONS

S. Tanaka et al. "Non-contact Atomic Force Microscopy Observation of 5-(4-methylthiophenyl)-10,15,20-tris(3,5-di-t-butylphenyl)porphyrin" Thin Solid Films v438-439 (2003) p. 56-60 available online Jun. 20, 2003.*
Web entry entitled "Fundamentals of ion Sputtering" shown available at Aug. 19, 2001 by the internet wayback machine: http://web.archive.org/web/20010819015950/http://home.earthlink.net/~chutko/fundam.htm.*
Yokoyama et al "Control of Molecular Selective-Assembling on Metal Surface" Chapter 5 of Nanotechnology and Nano-Interface Controlled Electronic Devices, Published by Elsevier Science & Technology Books, Feb. 2003, pp. 49-61. Edited by Iwamoto et al.*
Meli et al "Self-Assembled Masks for the Transfer of Nanometer-Scale Patterns into Surfaces: Characterization by AFM and LFM" NanoLetters V2, No. 2, p. 131-135, 2002.*
Hasegawa et al "Electronic Structures of Gold Nanowires" Chemical Physics Letters 345 (2001) 367-371.*
J. V. Barth et al.; Physical Review B, vol. 42, No. 15, pp. 9307-9318; Nov. 15, 1990.
Takashi Yokoyama et al.; Journal of Chemical Physics; vol. 115, No. 8, pp. 3814-3818; Aug. 22, 2001. Discussed in the specification.
T. A. Jung et al.; Letters to Nature, vol. 386, pp. 696-698; Apr. 17, 1997.
Takashi Yokoyama et al.; Letters to Nature, vol. 413, pp. 619-621; Oct. 11, 2001. Discussed in the specification.
Toshiya Kamikado et al.; "Selective Molecular Aggregation on a Gold Surface of Phenylporphyrins" PII-22, pp. 175-176.

* cited by examiner

*Primary Examiner* — Nathan H Empie
(74) *Attorney, Agent, or Firm* — Westerman, Hattori, Daniels & Adrian, LLP

(57) ABSTRACT

The present invention provides a process for producing a bottom-up type nano-device in which a reaction is initiated from potential singular points on a substrate, and wherein compound molecules are arranged with regularity and a chain reaction is accelerated utilizing the sequence pattern of the potential singular points, specifically, the process comprises a step of producing potential singular points that involves placing potential singular points on a substrate and a contact step of contacting a compound having a functional group which interacts with the fore-mentioned potential singular points.

6 Claims, 8 Drawing Sheets

PROCESS FOR PRODUCING NANO-DEVICE USING POTENTIAL SINGULAR POINTS ON SUBSTRATE

BACKGROUND OF THE INVENTION

1. Field of the Invention

The invention relates to a process for producing a nano-device by providing potential singular points on a substrate, capturing various molecules in the singular points and controlling the conformation of the various molecules with the singular points and a process for producing a nano-device by controlling a chemical reaction using the sequencing with singular points process method, etc.

2. Description of the Related Art

Molecular devices having functions at nanoscale have been vigorously studied. Such nano-devices are expected not only to be the next generation of silicon devices, but also devices for various functions. The development of new materials and technical developments which have been conventionally considered impractical or impossible can be realized by nano material and its processing technology by controlling an atom and a molecule at nano level and making the most use of the properties of a substance thereby. It is expected that in the future molecular devices having functions at nanoscale will be applied not only to materials and devices, but also to other fields such as optics, electronics, medicine, bio, environment and energy. Trials for controlling molecular sequence have been recently carried out utilizing the self-organization of molecules of porphyrin compounds on a metal surface for procuring the development of a molecular device.

For example, it is known that 5,10,15,20-tetrakis-(3,5-ditertiary-butylphenyl)porphyrin ($H_2$-TBPP) is regularly aggregated on a gold (111) surface (refer to the non-patent literature 1: Barth et. al., Phys. Rev. B42, 9307-9318 (1990)).

Thus, tetrakis-(3,5-ditertiary-butylphenyl)porphyrin derivatives are actively studied as the initiator of a molecular device (refer to the non-patent literature 2: T. Yokoyama, S. Yokoyama, T. Kamikado and S. Mashiko, J. Chem. Phys. 115 (2001) 3814), and the non-patent literature 3: T. A. Tung, R. R. Schlittler and J. K. Gimzewski, Nature 386 (1997) 696).

Further, it is known that the four legs of a porphyrin derivative are convertible to various kinds of functional groups for adjusting the strength of interaction with a substrate (refer to the non-patent literature 4: T. Kamikado, S. Yokoyama, T. Yokoyama, Y. Okuno and S. Mashiko, Abstract of the $5^{th}$ International Conference on Nano-molecular Electronics (ICNME 2002) 175).

Furthermore, there is known a method by which the dipole moment of a molecule is controlled by introducing a different functional group to one or two of the four legs of a porphyrin derivative, thereby controlling the reaction direction (refer to the non-patent literature 5: T. Yokoyama, S. Yokoyama, T. Kamikado, Y. Okuno and S. Mashiko, Selective assembly on a surface of supramolecular aggregates with controlled size and shape, Nature, Vol. 413 pp 619-621 (2001)).

However, with respect to the above technologies, there has been a problem that it is not always clear from what site on a substrate a reaction preceeds.

SUMMARY OF THE INVENTION

It is one object of the present invention to provide a process for producing a bottom-up type nano-device wherein a reaction is initiated from potential singular points on a substrate.

It is another object of the present invention to provide a process for producing a nano-device wherein compound molecules are arranged with regularity and a chain reaction is accelerated utilizing the sequence pattern.

It is another object of the present invention to provide a process for producing a nano-device wherein a plural number of compound molecules are arranged with regularity, the distance between the compound molecules is controlled and a chemical reaction between the compound molecules is controlled.

It is another object of the present invention to provide a process for producing a nano-device wherein the conformation of a molecular device can be easily controlled.

In order to solve at least one of the above-mentioned problems, the present invention provides a process for producing a nano-device comprising a step of producing potential singular points that involves placing the potential singular points on a substrate and a contact step of contacting a compound having a functional group which interacts with the fore-mentioned potential singular points on said substrate. Thus, a bottom-up type process for producing a molecular device in a site where molecules can be grown and their positional relation and the like are controlled is achieved by first providing the potential singular points on a substrate.

The present invention controls the conformation of a molecule which constitutes the nano-device by controlling the position of the potential singular points on a substrate, in the fore-mentioned step of producing potential singular points.

The present invention controls the conformation of a molecule which constitutes the nano-device by controlling the position of the fore-mentioned potential singular points on a substrate and further controls a reaction between compounds which constitute the nano-device, in the fore-mentioned step of producing potential singular points.

The present invention may further comprise a compound-bonding step of bonding compounds to each other via the fore-mentioned potential singular points.

The present invention may further comprise a step of bonding a compound combined with the substrate via the fore-mentioned potential singular points to another compound that is bonded (connected) to said compound, after the fore-mentioned contact step.

The present invention relates more preferably to the fore-mentioned potential singular points being recesses placed in the substrate wherein the depth of each recess is 1 to 50 angstroms, and is formed by using an electron beam, a convergent atomic beam, a convergent ion beam and nano-lithography.

The present invention relates more preferably to the compound having a functional group which interacts with the fore-mentioned potential singular points being a porphyrin compound represented by the following General Formula (I).

(I)

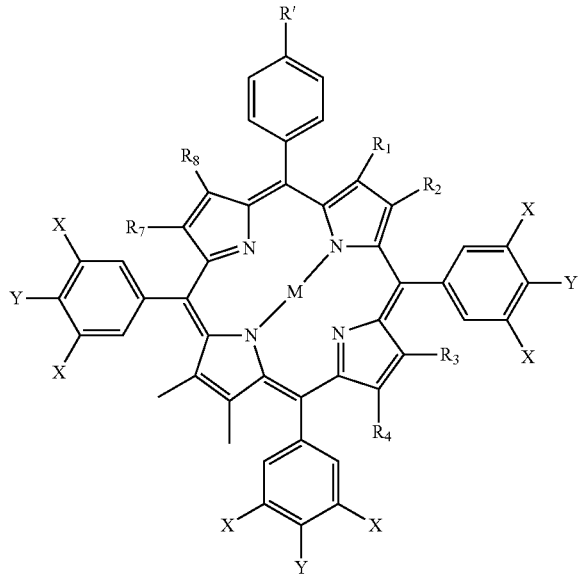

(wherein M represents either two hydrogen atoms, a divalent metal, a trivalent metal derivative, or a tetravalent metal derivative;

R' represents either a $C_{2-12}$ alkenyl group, a $C_{2-12}$ alkenyloxy group, a $C_{3-6}$ dienyl group, a $C_{2-12}$ alkynyl group, a $C_{2-12}$ alkynyloxy group, a hydroxyl group, a $C_{1-12}$ alkoxy group, a $C_{1-12}$ acyl group, a $C_{1-30}$ acyloxy group, a carboxyl group, a $C_{1-12}$ alkoxycarbonyl group, a carbamoyl group, a $C_{1-12}$ alkylcarbamoyl group, an amino group, a $C_{1-12}$ alkylamino group, an arylamino group, a cyano group, an isocyano group, a $C_{1-12}$ acylamino group, a nitroso group, a nitro group, a mercapto group, a $C_{1-12}$ alkylthio group, a sulfo group, a sulfino group, a $C_{1-12}$ alkylsulfonyl group, a thiocyanate group, an isothiocyanate group, a thiocarbonyl group, a sulfamoyl group, a $C_{1-12}$ alkylsulfamoyl group, a hydroxyiminomethyl group (—CH═NOH), a $C_{1-12}$ alkoxyiminomethyl group, a $C_{1-12}$ alkenyloxyiminomethyl group, a $C_{1-12}$ alkynyloxyiminomethyl group, a $C_{1-12}$ alkyliminomethyl group, a $C_{1-12}$ alkylsulfamoyliminomethyl group, a thiocarboxyl group, a hydroxyaminocarbonyl group, an alkoxyaminocarbonyl group, or halogen;

X represents either a $C_{1-12}$ alkyl group, a $C_{1-12}$ alkoxy group, a trialkylsilyloxy group, a phenyldialkylsilyloxy group, or a alkyldiphenylsilyloxy group;

Y represents either a hydrogen atom, a hydroxy group, a $C_{1-30}$ alkoxy group, a $C_{2-30}$ alkenyloxy group, a $C_{2-30}$ alkynyloxy group, or a $C_{1-30}$ acyloxy group;

and each of $R_5$ to $R_{12}$ represents independently a hydrogen atom, a halogen atom, an amino group, a hydroxy group, a nitro group, a cyano group, or a $C_{1-3}$ alkyl group which may optionally have a substituent.)

In General Formula (I), X is preferably a tertiary-butyl group.

In General Formula (I), M is preferably two hydrogen atoms, and R' is either a $C_{1-12}$ alkylthio group, a cyano group, a hydroxyl group, a carboxyl group, an amino group, a formyl group, a carbamoyl group, a nitro group, a hydroxyiminomethyl group (—CH═NOH), an ethynyl group, a hydroxyaminocarbonyl group, or a sulfamoyl group.

In General Formula (I), R' is more preferably a methylthio group.

In the present invention, the compound having a functional group interacting with the fore-mentioned potential singular points is more preferably 5-(4-methylthiophenyl)-10,15,20-tris-(3,5-ditertiary-butylphenyl)porphyrin ("MSTBPP").

The present invention can provide a process for producing a bottom-up type nano-device by placing potential singular points at specific points on a substrate and initiating a reaction from the potential singular points.

The present invention can provide a process for producing a nano-device wherein compound molecules are arranged with regularity by placing potential singular points at specific points on a substrate and initiating a reaction from the potential singular points and a chain reaction is accelerated utilizing the sequence pattern created by the singular points arrangement.

The present invention can provide a process for producing a nano-device wherein a plural number of compound molecules are arranged with regularity by placing potential singular points at specific points on a substrate and initiating a reaction from the potential singular points, so that the distance between the compound molecules is controlled and hence a chemical reaction between the compound molecules is controlled.

The present invention can provide a process for producing a nano-device wherein the conformation of a molecular device can be easily controlled by placing potential singular points at specific points on a substrate and initiating a reaction from the potential singular points.

BRIEF DESCRIPTION OF THE DRAWINGS

FIG. 1 is a figure showing a first embodiment of the present invention.

FIG. 2 is a photograph showing the condition of a substrate.

FIG. 3 (B) is a case in which the terrace edge lines are warped;

DETAILED DESCRIPTION OF THE PREFERRED EMBODIMENTS

The embodiments of the present invention are specifically explained below based on the drawings. FIG. 1 is a view showing a first embodiment of the present invention.

Figure 1A:
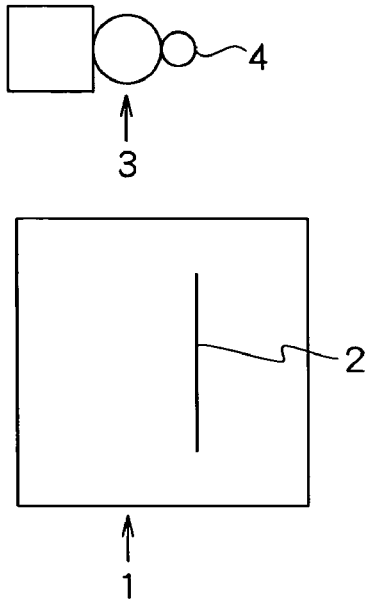
FIG. 1(A) is a view illustrating a substrate and a compound.

FIG. 1(A) is a drawing illustrating a substrate and a compound. As shown in FIG. 1(A), to produce nano-devices a substrate 1 is used, and potential singular points 2 which have different potential energy from their surroundings are provided on the substrate 1. Further, when the nano-device is produced in the present invention, a compound 3 is used, and the compound 3 has a functional group 4 (or functional groups) which interact(s) with the potential singular points.

In this specification, the 'nano-device' means a molecular aggregate in which a bonding position and the like are controlled at a molecular level, wherein the molecular aggregate and the substrate are integrated. It is preferably a device having predetermined functions such as a switching function and an ON/OFF function.

In this specification, the 'interaction' means intermolecular forces such as Van der Waals force, hydrogen bonding, dipole-dipole moment interaction, and a series of interactions related to chemical, physical and/or electrical reaction between neighboring molecules.

In this specification, the 'potential singular points' means a site, an area, or points in which potential energy is locally and greatly changed by chemical or physical factors in comparison with a surrounding site, for example, a recess portion on a substrate. The depth of such a recess is preferably 1 to 50 angstroms, more preferably 5 to 40 angstroms and further preferably 10 to 25 angstroms. The "potential singular points" include the pattern which automatically exists on the substance and defect structures. "Patterns which automatically exist on the substance" include a Herring bone structure on a gold surface and so on. The "defect structures" includes defects of oxygen molecule on the surface of oxide, and scratched shape on Alkali-Halide and so on.

The potential singular points are preferably formed by using an electron beam, a convergent atomic beam, a convergent ion beam or nanolithography.

Figure 1B:
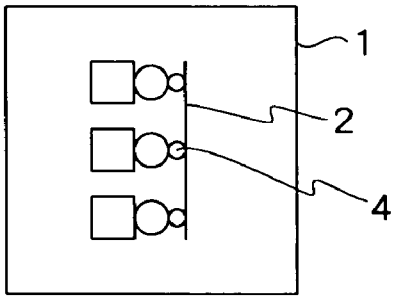
FIG. 1(B) is a view illustrating an aspect in which the substrate is interacted with the compound when the potential singular points are nearly linear.
Figure 1C:
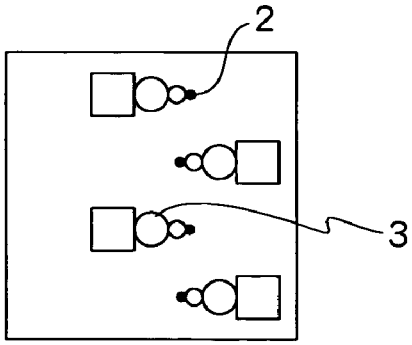
FIG. 1(C) is a view showing an aspect in which the substrate is interacted with the compound when the potential singular points are provided at points of nearly equal intervals.

FIG. 1(B) is a view showing an aspect in which the substrate is interacted with the compound when the potential singular points are nearly linear. The above-mentioned compound is brought in contact with the above-mentioned substrate having the potential singular points. Then, as shown in FIG. 1(B), the potential singular points 2 on the substrate interact with the functional group 4 of the compound, and the compound is arranged on the substrate. FIG. 1(C) is a view showing the substrate interacted with the compound when the potential singular points are provided at points of nearly equal intervals. Namely, an intermolecular distance and a space position can be controlled by controlling the interval at which the potential singular points are provided. Accordingly, a nano-device with controlled intramolecular intervals is produced.

The production process of the present invention is preferably carried out in a chamber with an ultra high vacuum, and the pressure in the chamber is preferably $10^{-8}$ Pascal or less, more preferably $10^{-9}$ Pascal or less and further preferably $10^{-10}$ Pascal or less.

The compound is accumulated on the substrate by known deposition methods such as, for example, a chemical deposition method and a physical deposition method. The deposition method of the compound is preferably a deposition method using a Knudsen cell at 300 to 400K, or a molecule scattering method by introducing mists in the chamber by a syringe and the like.

Figure 1D:
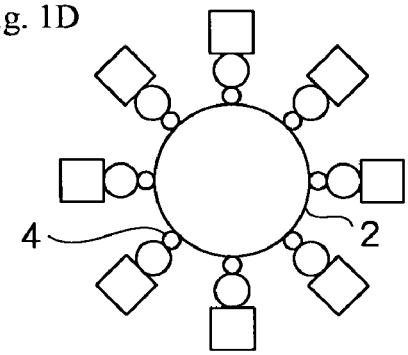
FIG. 1(D) is a view showing an aspect in which the substrate is interacted with the compound when the potential singular points are nearly circular.
Figure 1E:
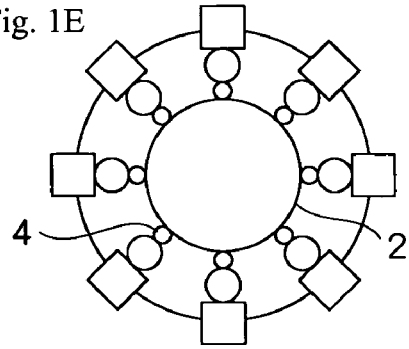
FIG. 1(E) is a view in which the compound is nearly circularly arranged on the substrate and the reaction between the compounds occurs.

FIG. 1(D) is a view showing an aspect in which the substrate is interacted with the compound when the potential singular points are nearly circular. In this case, the circular potential singular points 2 interacted with the functional groups 4 of the compounds, and the compounds are arranged in a nearly circular shape. For example, when the potential singular points are provided at equal intervals to form the circle of FIG. 1(D), the arrangement of the compounds is also at equal intervals. When the compounds are circularly arranged, a chemical reaction of the mutually arranged compounds can be accelerated. A view in which the compounds are nearly circularly arranged on the substrate, and the reaction between the compounds proceeds is shown in FIG. 1(E).

Figure 1F:
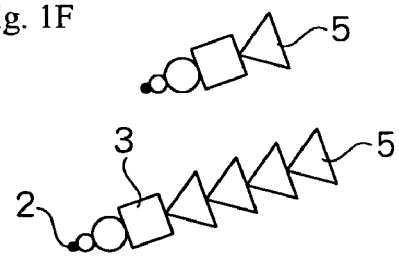
FIG. 1(F) is a view showing an aspect in which the compound 3 bonded with the potential singular points is interacted with another compound 5.

Further, in the present invention, the compound 3 bonded with the substrate may be bonded with one or more other compounds 5. FIG. 1(F) is a view illustrating the compound 3 bonded with the potential singular points 2 and interacted with other compounds 5. Thus, a nano-device in which a selected position of the substrate was a starting point can be produced.

Figure 1G:
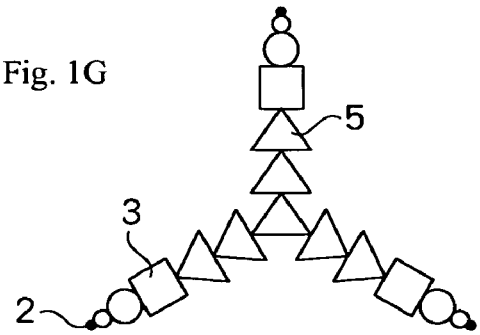
FIG. 1(G) is a view showing the compounds bonded with potential singular points and interacted with other compounds to control the conformation of the compounds.

FIG. 1(G) is a view illustrating the compound 3 bonded with the potential singular points 2 and interacted with other compounds 5 when the position of the potential singular points are formed to be the apex points of a near triangle. As shown in FIG. 1(G), the conformation of the polymerization of the compound formed on the substrate can be controlled by controlling the position of the potential singular points.

In the present invention, for example, a compound is accumulated on a metal surface as the substrate. The shape of the substrate may be flat, but a substrate having steps (the potential singular points) of a regular cycle and being arranged in parallel is obtainable by shaving a specific index plane using the single crystal of a metal and carrying out an appropriate thermal treatment. Such substrate is called a finely slant substrate. The metal used for the substrate may include a metal formed on a substrate such as mica or glass by deposition and the like, and a metal itself may be used. However, using a substrate such as mica or glass is preferable. The substrate is further preferably mica. The surface roughness of mica is preferably 50 nm or less, more preferably 1 nm or less, and further preferably 0.5 nm or less. When the surface roughness is around the above range, the surface of a metal is made flat, and the circumstance in which a compound enters into the unevenness which was generated on the surface of a metal can be prevented. The surface roughness means a roughness of a square average (Rs).

The metal constituting the metal surface includes gold, copper, platinum, silver, tungsten and the like. Among these, gold is preferable and the (111) surface of gold is more preferable. Because the (111) surface of gold is inactive a chemical reaction with a sample molecule and the like is prevented.

Further, when the thin film of a metal is formed on the substrate, the surface roughness is preferably 50 nm or less, more preferably 10 nm or less, further preferably 5 nm or less, furthermore preferably 1 nm or less and most preferably 0.5 nm or less in particular. When the surface roughness of the thin film of a metal thus formed on the substrate is small, the circumstance in which a compound enters into the recess on the film of a metal can be prevented.

As the compound having a functional group interacting with the potential singular points, the porphyrin compound represented by the under-mentioned General Formula (I) is preferred. Other preferred compounds are phtalocyanine or phtalocyanine derivatives which may contain metal ions.

The compound represented by the following General Formula (I) is illustrated below.

(I)

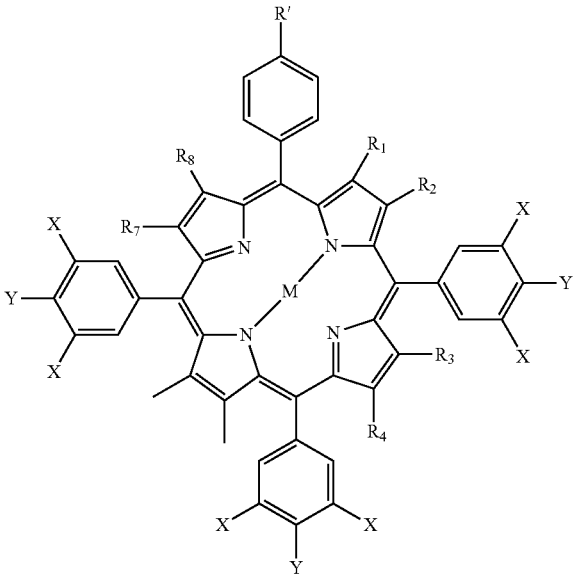

(wherein M represents either two hydrogen atoms, a divalent metal, a trivalent metal derivative, or a tetravalent metal derivative; R' represents either a $C_{2-12}$ alkenyl group, a $C_{2-12}$ alkenyloxy group, a $C_{3-6}$ dienyl group, a $C_{2-12}$ alkynyl group, a $C_{2-12}$ alkynyloxy group, a hydroxyl group, a $C_{1-12}$ alkoxy group, a $C_{1-12}$ acyl group, a $C_{1-30}$ acyloxy group, a carboxyl group, a $C_{1-12}$ alkoxycarbonyl group, a carbamoyl group, a $C_{1-12}$ alkylcarbamoyl group, an amino group, a $C_{1-12}$ alkylamino group, an arylamino group, a cyano group, an isocyano group, a $C_{1-12}$ acylamino group, a nitroso group, a nitro group, a mercapto group, a $C_{1-12}$ alkylthio group, a sulfo group, a sulfino group, a $C_{1-12}$ alkylsulfonyl group, a thiocyanate group, an isothiocyanate group, a thiocarbonyl group, a sulfamoyl group, a $C_{1-12}$ alkylsulfamoyl group, a hydroxyiminomethyl group (—CH═NOH), a $C_{1-12}$ alkoxyiminomethyl group, a $C_{1-12}$ alkenyloxyiminomethyl group, a $C_{1-12}$ alkynyloxyiminomethyl group, a $C_{1-12}$ alkyliminomethyl group, a $C_{1-12}$ alkylsulfamoyliminomethyl group, a thiocarboxyl group, a hydroxyaminocarbonyl group, an alkoxyaminocarbonyl group, or halogen; X represents either a $C_{1-12}$ alkyl group, a $C_{1-12}$ alkoxy group, a trialkylsilyloxy group, a phenyldialkylsilyloxy group, or a alkyldiphenylsilyloxy group; Y represents either a hydrogen atom, a hydroxy group, a $C_{1-30}$ alkoxy group, a $C_{2-30}$ alkenyloxy group, a $C_{2-30}$ alkynyloxy group, or a $C_{1-30}$ acyloxy group; and each of $R_1$ to $R_8$ represents independently either a hydrogen atom, a halogen atom, an amino group, a hydroxy group, a nitro group, a cyano group, or a $C_{1-3}$ alkyl group which may optionally have a substituent.)

In General Formula (I), M represents either two hydrogen atoms, a divalent metal, a trivalent metal derivative, or a tetravalent metal derivative, preferably either two hydrogen atoms, Cu, Zn, Fe, Co, Ni, Ru, Pb, Rh, Pd, Pt, Mn, Sn, Au, Mg, Cd, AlCl, InCl, FeCl, MnCl, $SiCl_2$, $GeCl_2$, Vo, TiO, $SnCl_2$, Fe-Ph, SnC≡C-Ph, or Rh—Cl, and more preferably two hydrogen atoms.

In General Formula (I), for example, each of $R_1$ to $R_8$ represents independently a hydrogen atom, a halogen atom, an amino group, a hydroxy group, a nitro group, a cyano group, or a $C_{1-3}$ alkyl group which may optionally have a substituent, and more preferably a hydrogen atom.

In General Formula (I), R' functions usually as the functional group interacted with the potential singular points. R' represents either of a $C_{2-12}$ alkenyl group, a $C_{2-12}$ alkenyloxy group, a $C_{3-6}$ dienyl group, a $C_{2-12}$ alkynyl group, a $C_{2-12}$ alkynyloxy group, a hydroxyl group, a $C_{1-12}$ alkoxy group, a $C_{1-12}$ acyl group, a $C_{1-30}$ acyloxy group, a carboxyl group, a $C_{1-12}$ alkoxycarbonyl group, a carbamoyl group, a $C_{1-12}$ alkylcarbamoyl group, an amino group, a $C_{1-12}$ alkylamino group, an arylamino group, a cyano group, an isocyano group, a $C_{1-12}$ acylamino group, a nitroso group, a nitro group, a mercapto group, a $C_{1-12}$ alkylthio group, a sulfo group, a sulfino group, a $C_{1-12}$ alkylsulfonyl group, a thiocyanate group, an isothiocyanate group, a thiocarbonyl group, a sulfamoyl group, a $C_{1-12}$ alkylsulfamoyl group, a hydroxyiminomethyl group (—CH═NOH), a $C_{1-12}$ alkoxyiminomethyl group, a $C_{1-12}$ alkenyloxyiminomethyl group, a $C_{1-12}$ alkynyloxyiminomethyl group, a $C_{1-12}$ alkyliminomethyl group, a $C_{1-12}$ alkylsulfamoyliminomethyl group, a thiocarboxyl group, a hydroxyaminocarbonyl group, an alkoxyaminocarbonyl group, or halogen.

Preferable functional groups for R' in General Formula (I) are as follows. The $C_{2-12}$ alkenyl group includes a vinyl group ($CH_2$═CH—), a 1-propenyl group ($CH_3CH_2$═CH—), an allyl group ($CH_2$═$CHCH_2$—), a 3-methyl-2-butenyl group ($CH_3$—C($CH_3$)═$CHCH_2$—) and the like. As the $C_{2-12}$ alkenyl group, a $C_{2-8}$ alkenyl group is preferable, a $C_{2-6}$ alkenyl group is more preferable and a $C_{2-4}$ alkenyl group is preferable in particular.

The $C_{2-12}$ alkenyloxy group includes a 2-propenyloxy group, a 2-butenyloxy group, a 3-butenyloxy group, a 4-pentenyloxy group, a 9-decen-1-yloxy group, a 11-dodecen-1-yloxy group, a 9,12-tetradecadien-1-yloxy group, a 9-hexadecen-1-yloxy group, a 9,12-tetradecadien-1-yloxy group, a 10,12-pentadien-1-yloxy group and the like. As the $C_{2-12}$ alkenyloxy group, a $C_{2-10}$ alkenyloxy group is preferable, a $C_{2-8}$ alkenyloxy group is further preferable, a $C_{2-6}$ alkenyloxy group is more preferable and a $C_{2-4}$ alkenyloxy group is preferable in particular.

A $C_{3-6}$ dienyl group includes a 1,3-butadienyl group ($CH_2$═CHCH═CH—) and the like.

The $C_{2-12}$ alkynyl group includes an ethynyl group (CH≡C—), a 1-propynyl group, a 2-propynyl group, a 1-butynyl group, a 2-butynyl group, a 3-butynyl group, a 1-propynyl group, a 2-propynyl group, a 3-propynyl group, a 4-propynyl group, a 1-methyl-2-propynyl group and the like. As the $C_{2-12}$ alkynyl group, a $C_{2-8}$ alkynyl group is preferable, a $C_{2-6}$ alkynyl group is further preferable and a $C_{2-4}$ alkynyl group is preferable in particular.

The $C_{2-12}$ alkynyloxy group includes an ethynyloxy group, a 1-propynyloxy group, a 2-propynyloxy group, a 1-butynyloxy group, a 2-butynyloxy group, a 3-butynyloxy group, a 1-propynyloxy group, a 2-propynyloxy group, a 3-propynyloxy group, a 4-propynyloxy group, a 1-methyl-2-propynyloxy group, a 5-hexyn-1-yloxy group, a 9-decyn-1-yloxy group, a 11-dodecyn-1-yloxy group, a 10,12-pentacosandiyl-1-yloxy group and the like.

The $C_{1-12}$ alkoxy group ($C_nH_{2n+1}O$—) includes a methoxy group, an ethoxy group, a n-propoxy group, an isopropoxy group, a n-butoxy group, a sec-butoxy group, an isobutoxy group, a tert-butoxy group, a pentyloxy group, an amyloxy group, an octyloxy group, a decyloxy group, a dodecyloxy group, a hexadecyloxy group, a docosan-1-yl group, a pentacosan-1-yl group, a triacontan-1-yl group and the like. As the $C_{1-12}$ alkoxy group, a $C_{1-10}$ alkoxy group is more preferable, a $C_{1-8}$ alkoxy group is further preferable and a $C_{1-6}$ alkoxy group is preferable in particular.

The $C_{1-12}$ acyl group (RCO—) includes a formyl group (CHO—), an acetyl group ($CH_3CO$—), a propionyl group ($C_2H_5CO$—), an isobutyryl group, a valeryl group ($C_4H_9CO$—), a pivaloyl group ($(CH_3)_3CCO$—), an octanonyl group ($CH_3(CH_2)_6CO$—), a lauroyl group ($CH_3(CH_2)_{10}CO$—) and the like.

The $C_{1-30}$ acyloxy group (RCHOO—) includes a formyloxy group, a methoxycarbonyl (acetyloxy) group ($CH_3COO$—), an ethoxycarbonyl group ($C_2H_5COO$—), a propionyloxy group, a hexanoyloxy group, an octanoyloxy group, a lauroyloxy group, a palmitoyloxy group, a stearoyloxy group, a pentacosanoyloxy group, a triacontanoyloxy group, a methacryloyloxy group, a 9-decenoyloxy group, a 9-octadecenoyloxy group, a 9,12-octadecadienoyloxy group, a 10,12-pentacosadienoyloxy group, a propioyloxy group, a 9-decinoyloxy group, a 2,4-pentadecadiinoyloxy group, a 10,12-pentacosadiinoyloxy group and the like. As the $C_{1-30}$ acyloxy group, a $C_{1-10}$ acyloxy group is preferable, a $C_{1-8}$ acyloxy group is more preferable, a $C_{1-6}$ acyloxy group is further preferable and a $C_{1-4}$ acyloxy group is preferable in particular.

As the $C_{1-12}$ alkoxycarbonyl group, a $C_{1-6}$ alkoxycarbonyl group (ROCO—) is preferable, and as the $C_{1-6}$ alkoxycarbonyl group (ROCO—), a methoxycarbonyl group, an ethoxycarbonyl group and the like are mentioned. Further, in the present specification, R means an alkyl group unless otherwise noticed.

As the $C_{1-12}$ alkylcarbamoyl group, a $C_{1-6}$ alkylcarbamoyl group ($R_2NCO$—) is preferable, and the $C_{1-6}$ alkylcarbamoyl group ($R_2NCO$—) includes a methylcarbamoyl group ($CH_3NHCO$—), a dimethylcarbamoyl group ($(CH_3)_2NCO$—), an ethylcarbamoyl group, a diethylcarbamoyl group, a methylethylcarbamoyl group and the like.

As the $C_{1-12}$ alkylamino group, a $C_{1-6}$ alkylamino group is preferable, and the $C_{1-6}$ alkylamino group includes secondary $C_{1-6}$ alkylamino groups such as a methylamino group and an ethylamino group, tertiary $C_{1-6}$ alkylamino groups such as a dimethylamino group, a diethylamino group and a methylethylamino group and the like.

As the $C_{1-12}$ acylamino group, a $C_{1-6}$ acylamino group (RCONH—) is preferable, and the $C_{1-6}$ acylamino group (RCONH—) includes an acetylamino group ($CH_3CONH$—) and the like.

As the $C_{1-12}$ alkylthio group, a $C_{1-6}$ alkylthio group is preferable, and as the $C_{1-6}$ alkylthio group, a methylthio group ($CH_3S$—), an ethylthio group and a propylthio group are preferable, and a methylthio group is preferable in particular.

As the $C_{1-12}$ alkylsulfonyl group, a $C_{1-6}$ alkylsulfonyl group is preferable, and the $C_{1-6}$ alkylsulfonyl group includes a methylsulfonyl group ($CH_3SO_2$—), an ethylsulfonyl group, a propylsulfonyl group and the like.

As the $C_{1-12}$ alkylsulfamoyl group, a $C_{1-6}$ alkylsulfamoyl group is preferable, and the $C_{1-6}$ alkylsulfamoyl group includes a methylsulfamoyl group and an ethylsulfamoyl group.

As the $C_{1-12}$ alkoxyiminomethyl group, a $C_{1-6}$ alkoxyiminomethyl group is preferable, and a methoxyiminomethyl group and an ethoxyiminomethyl group are more preferable.

As the $C_{1-12}$ alkenyloxyiminomethyl group, a $C_{1-6}$ alkenyloxyiminomethyl group is preferable.

As the $C_{1-12}$ alkynyloxyiminomethyl group, a $C_{1-6}$ alkynyloxyiminomethyl group is preferable.

As the $C_{1-12}$ alkyliminomethyl group, a $C_{1-6}$ alkyliminomethyl group is preferable.

As the $C_{1-12}$ alkylsulfamoyliminomethyl group, a $C_{1-6}$ alkylsulfamoyliminomethyl group is preferable.

As the alkoxyaminocarbonyl group, a $C_{1-6}$ alkoxyaminocarbonyl group is preferable.

Halogen includes fluorine, chlorine, bromine, sulfur and the like.

In General Formula (I), R' is preferably a methylthio group in particular.

In General Formula (I), X includes a $C_{1-8}$ alkyl group, a $C_{1-8}$ alkoxy group, a trialkylsilyloxy group, and a phenyldialkylsilyloxy group. As the $C_{1-8}$ alkyl group, a $C_{1-6}$ alkyl group is preferable. As the $C_{1-8}$ alkoxy group, a $C_{1-6}$ alkoxy group is preferable. X is most preferably a tert-butyl group.

In General Formula (I), Y represents either of a hydrogen atom, a hydroxy group, a $C_{1-30}$ alkoxy group, a $C_{2-30}$ alkenyloxy group, a $C_{2-30}$ alkynyloxy group, or a $C_{1-30}$ acyloxy group. The $C_{1-30}$ alkoxy group ($C_nH_{2n+1}O$—) includes a methoxy group, an ethoxy group, a n-propoxy group, an isopropoxy group, a n-butoxy group, a sec-butoxy group, an isobutoxy group, a tert-butoxy group, a pentyloxy group, an amyloxy group, an octyloxy group, a decyloxy group, a dodecyloxy group, a hexadecyloxy group, a docosan-1-yl group, a pentacosan-1-yl group, a triacontan-1-yl group and the like. As the $C_{1-30}$ alkoxy group, a $C_{1-10}$ alkoxy group is preferable, a $C_{1-8}$ alkoxy group is further preferable and a $C_{1-6}$ alkoxy group is preferable in particular.

The $C_{2-30}$ alkenyloxy group includes a 2-propenyloxy group, a 2-butenyloxy group, a 3-butenyloxy group, a 4-pentenyloxy group, a 9-decen-1-yloxy group, a 11-dodecen-1-yloxy group, a 9,12-tetradecadien-1-yloxy group, a 9-hexadecen-1-yloxy group, a 9,12-tetradecadien-1-yloxy group, a 10,12-pentadien-1-yloxy group and the like. As the $C_{2-30}$ alkenyloxy group, a $C_{2-10}$ alkenyloxy group is preferable, a $C_{2-8}$ alkenyloxy group is further preferable, a $C_{2-6}$ alkenyloxy group is more preferable and a $C_{2-4}$ alkenyloxy group is preferable in particular.

The $C_{2-30}$ alkynyloxy group includes an ethynyloxy group, a 1-propynyloxy group, a 2-propynyloxy group, a 1-butynyloxy group, a 2-butynyloxy group, a 3-butynyloxy group, a 1-propynyloxy group, a 2-propynyloxy group, a 3-propynyloxy group, a 4-propynyloxy group, a 1-methyl-2-propynyloxy group, a 5-hexyn-1-yloxy group, a 9-decyn-1-yloxy group, a 11-dodecyn-1-yloxy group, a 10,12-pentacosandiyl-1-yloxy group, a 2,9-triacontayn-1-yloxy group and the like.

The $C_{1-30}$ acyloxy group (RCHOO—) includes a formyloxy group, a methoxycarbonyl (acetyloxy) group ($CH_3COO$—), an ethoxycarbonyl group ($C_2H_5COO$—), a propionyloxy group, a hexanoyloxy group, an octanoyloxy group, a lauroyloxy group, a palmitoyloxy group, a stearoyloxy group, a pentacosanoyloxy group, a triacontanoyloxy group, a methacryloyloxy group, a 9-decenoyloxy group, a 9-octadecenoyloxy group, a 9,12-octadecadienoyloxy group, a 10,12-pentacosadienoyloxy group, a propioyloxy group, a 9-decinoyloxy group, a 2,4-pentadecadiinoyloxy group, a 10,12-pentacosadiinoyloxy group and the like. As the $C_{1-30}$ acyloxy group, a $C_{1-10}$ acyloxy group is preferable, a $C_{1-8}$ acyloxy group is more preferable, a $C_{1-6}$ acyloxy group is further preferable and a $C_{1-4}$ acyloxy group is preferable in particular.

In General Formula (I), M is two hydrogen atoms, and R' is more preferably either of a $C_{2-12}$ alkylthio group, a cyano group, a hydroxy group, a carboxyl group, an amino group, a formyl group, a carbamoyl group, a nitro group, a hydroxyiminomethyl group (—CH═NOH), an ethynyl group, a hydroxyaminocarbonyl group, or a sulfamoyl group, and R' is further preferably a methylthio group.

Other compounds include any compound being interacted with the potential singular points utilizing the functional groups fore-mentioned, and having a functional group interact with a functional group other than the group used for bonding with the substrate. It is interacted through a functional group of a compound being interacted with the substrate. Example of the compound includes a compound containing a double bond or a triple bond as the functional group, etc.

EXAMPLE 1

Specifically detailed below is an experimental example utilizing a methylthiophenyl group as the functional group interacted with potential singular points on a substrate, a porphyrin-base molecular structure is utilized as the objective member to which the functional group is bonded, and the potential singular points are terrace edge lines formed on a single crystal plane (finely slant 111 plane) of gold.

The experimental example below was analyzed with a temperature-variable type scanning probe microscope system which was installed in an ultra high vacuum chamber that was controlled so as to maintain an inner pressure of $10^{-8}$ Pascal or less. The experiment was further analyzed by a scanning type electron tunneling microscopy mode (STM mode) and a non-contact atomic force microscopy mode (NC-AFM mode). A needle-pointed tungsten material to which electrolytic polishing was carried out, in the STM mode, and an n-doped electroconductive silicon cantilever that had a modulus of elasticity k of about 50 N/m and a resonance frequency f of about 300 kHz, in the NC-AFM mode were respectively used. A sample holder, a sample and an atomic probe portion were cooled to liquid nitrogen temperature with a cooling apparatus which was prepared for ultra high vacuum, in order to suppress the thermal vibration of an observation object at measurement and improve the resolution of acquired data.

The MSTBPP compound in the experimental example was produced by oxidizing 3,5-di-tert-butylbenzaldehyde and 4-methylthiobenzaldehyde with 2,3-dichloro-5,6-dicyano-1,4-benzoquinoline (DDQ) (T. Akiyama et. al., Chem. Let. (1996) 907, and F. Li et. al., Tetrahedron 53 (1997) 12339).

Figure 2A:
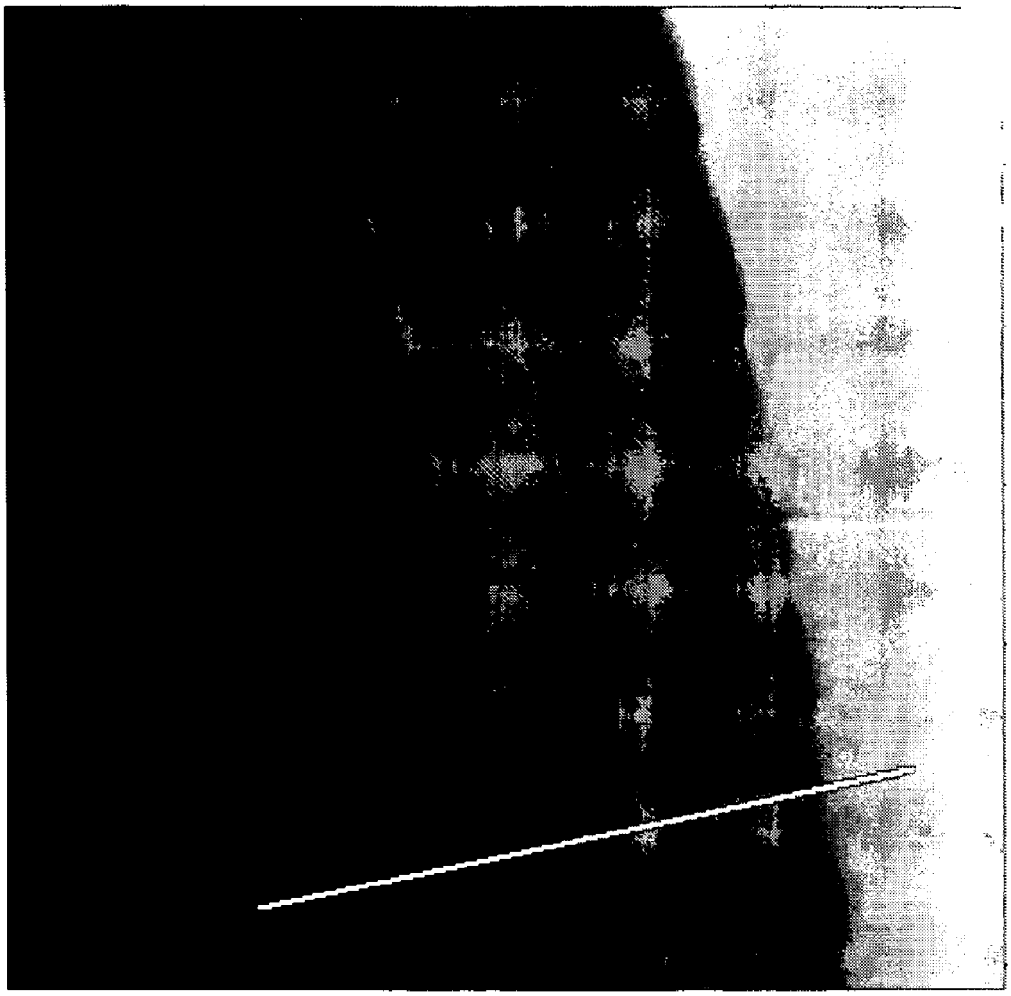
FIG. 2(A) is the STM photograph of the substrate.
Figure 2B:
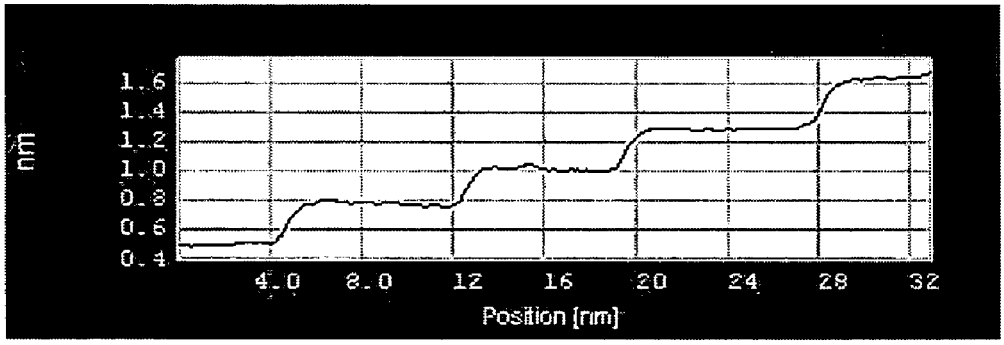
FIG. 2(B) is a graph showing the height of the line drawn in FIG. 2(A)

With respect to the substrate used for the observation, the impurities and non-adhering articles of its surface were removed by carrying out luster scanning while irradiating an Ar ion beam which was accelerated under an ultra high vacuum environment with a voltage difference of 1 kV against the finely slant (111) plane of the single crystal of gold, and further, the reconstruction of the surface was promoted by keeping the whole substrate at 900 K by heating. The process was repeated depending on the surface condition of the substrate obtained, to finally obtain the substrate on which clean and flat areas at atomic level were arranged with a fixed rule (FIG. 2). FIG. 2(A) is the STM photograph of the substrate, and FIG. 2(B) is a graph illustrating the height of the line portion which is shown in FIG. 2(A). Successively, the objective molecule was deposited on the substrate by irradiating an MSTBPP beam (hereat, the molecular beam was prepared by heating the sample at 300 to 400 K in a Knudsen cell) that was focused to the specific point on the substrate. Then, the whole substrate was further heated at 300 to 400 K for a short time to facilitate even cooling.

After completion of the deposition process, the sample was moved to another ultra high vacuum chamber without breaking ultra high vacuum conditions, and submitted to an observation experiment with a nanoprobe microscope. Feedback control based on the predetermined condition of usual tunneling electric current value was adopted for STM mode measurement, and the frequency modulating feedback mode (FM-feedback mode) with a frequency shift of 50 Hz to 200 Hz was adopted for NC-AFM mode measurement. The detailed motion principle of the measurement apparatus and experimental condition are described in the literature of Cbunli Bai (Scanning Tunneling Microscopy, Springer 1995) for the STM mode and in the literature of Morita et. al., (Non-contact Atomic Force Microscopy) for the NC-AFM mode.

Figure 3A:
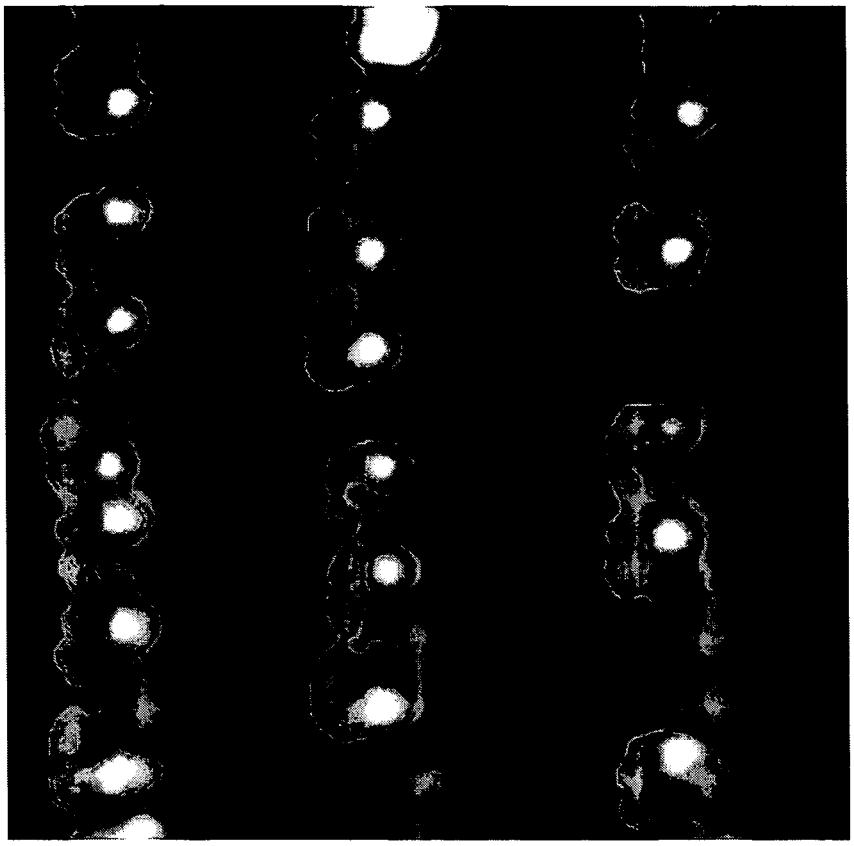
FIG. 3(A) is a case in which the terrace edge lines are linear.
Figure 3B:
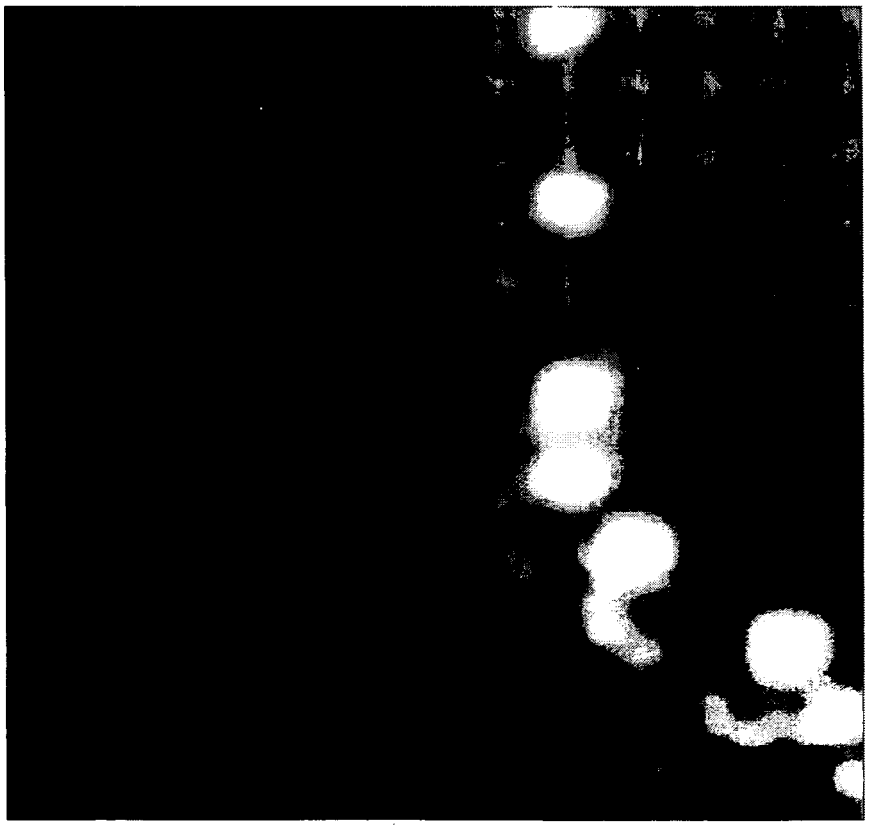
FIG. 3 is a STM photograph of the (111) surface of the gold substrate after deposition of a small amount of MSTBPP.
Figure 4:
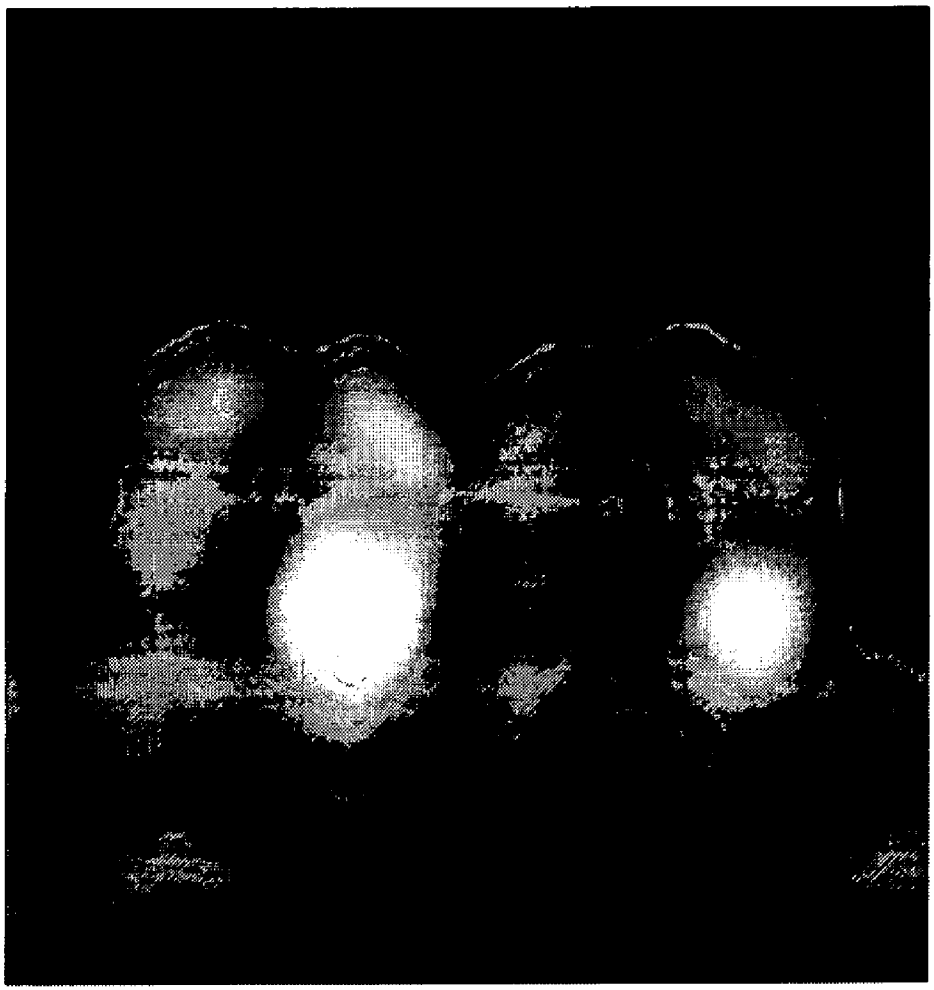
FIG. 4 is a magnified image of a section of FIG. 3A.

The STM image of the (111) surface of the gold substrate after deposition of a small amount of MSTBPP is shown in FIG. 3. It can be grasped from FIG. 3(A) that the molecules on the substrate are selectively and predominantly arranged along the edges of terraces which were formed on the substrate. Further, it can be grasped from FIG. 3(A) that the central positions of clear points corresponding to the molecule are arranged just at the boundary edges of the terraces. Namely, in the system, the centers of the clear points are situated at the sites (the potential singular points) of the boundary edge in which the potential is different from the surroundings. FIG. 3(B) is the STM image when the terrace edge lines were warped. It can also be grasped in this case that the molecule is always arranged along the edge lines (the potential singular points). Namely, the orientation of the molecule is determined by the geometrical shape of the substrate without depending on the crystal direction of the substrate. This is clear from the magnified image shown in FIG. 4. It was reported in the primary study of TBPP with a scanning tunneling microscopy (STM) that there are some differences in methods by which the molecule is absorbed and the methods change depending on the material of the substrate. The molecule which was dispersed on the Au (111) substrate remains on the inside of the terraces along the boundary lines. To the contrary, the molecule on Cu (100) is absorbed just on the boundary lines of terraces in a condition in which the central porphyrin ring crosses the boundary lines [Ch. Loppacher et. al., Appl. Phys. A72, (2001) 105]. It is considered that the reason why the difference occurs in the experiments of Cu (100) and Au (111) regarding the TBPP molecule is the difference in the strength of the attraction interaction of the molecule with the substrate. In general, the TBPP molecule is more strongly adsorbed on Cu (100) than Au (111). From this viewpoint, the results shown in FIG. 3(A), FIG. 3(B) and FIG. 4 are obtained because the methylthiophenyl group introduced in a porphyrin-base molecule strengthened the attraction interaction with the potential singular points on the substrate. The tendency is not lost even when the total amount of deposition was increased, therefore it is elucidated that it is a universal tendency which is observed in the combination of a Au (111) finely slant substrate with MSTBPP molecules.

Figure 5:
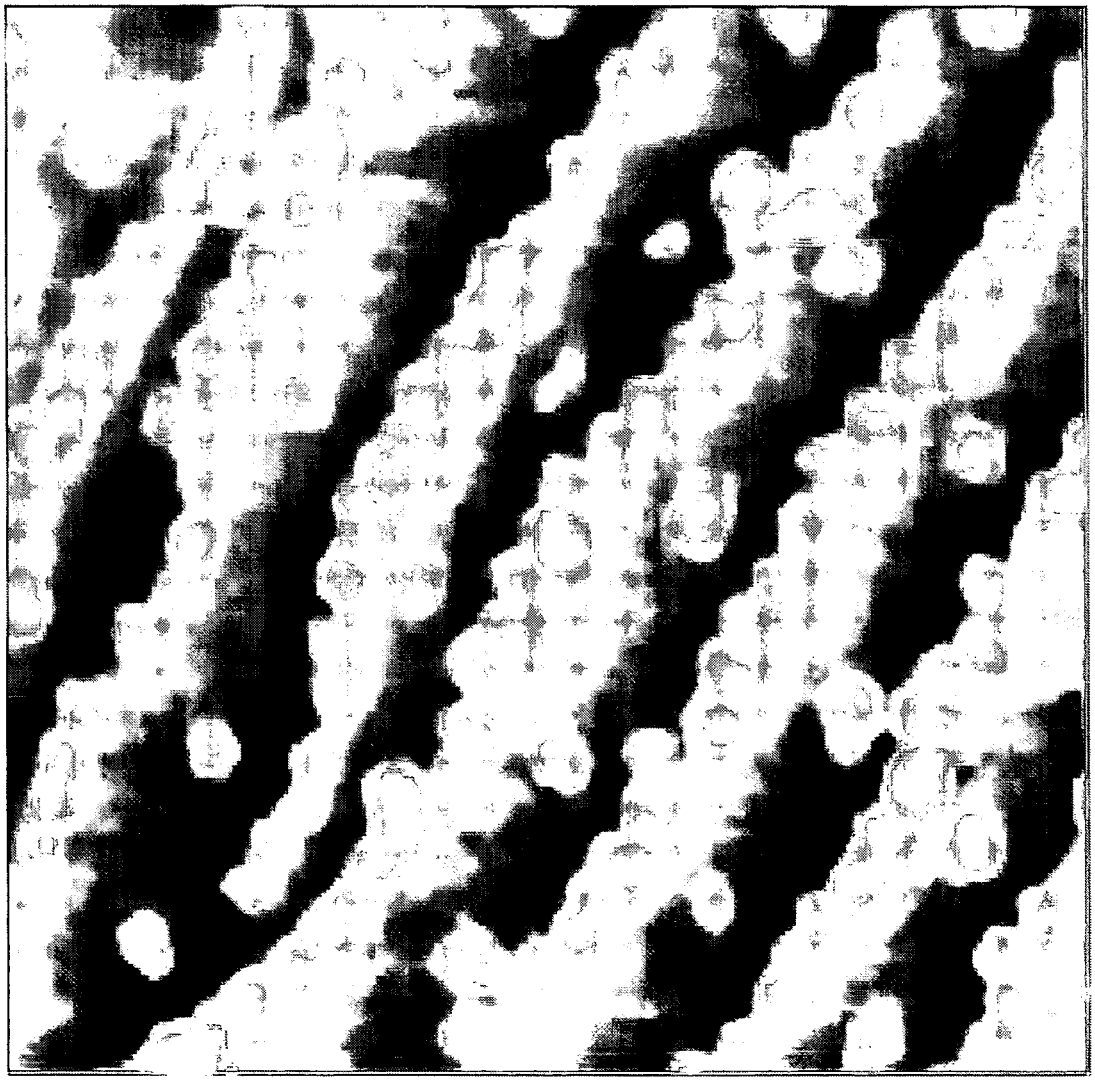
FIG. 5 is an NC-AFM photograph of MSTBPP on the Au (111) substrate.
Figure 6:
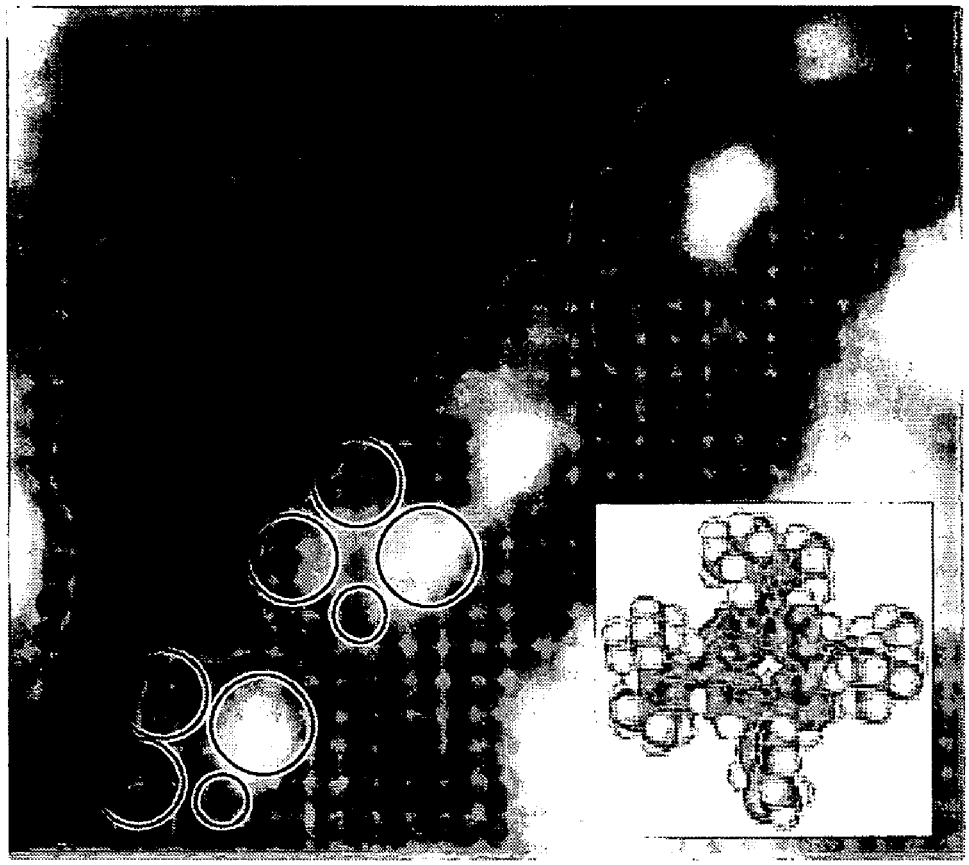
FIG. 6 is an NC-AFM photograph of MSTBPP on the Au (111) substrate with a molecular drawing inset of MSTBPP.

FIG. 5 and FIG. 6 show the NC-AFM image of MSTBPP on the Au (111) substrate with a range of 0.2 ML, and the clear points in the image come from the individual MSTBPP molecule respectively. Most molecules are arranged at the edges of respective terraces by the same method as described for FIG. 3 and FIG. 4 until the edge lines are completely occupied by the molecules. Considering the morphological feature of MTTBPP which is arranged along the edges of the terraces, it can be concluded that a powerful attraction interaction exists between the MSTBPP molecule and the Au (111) substrate in like manner as the case of combining Cu (100) with the TBPP molecule.

The clear points of FIG. 5 come from the individual MSTBPP molecule which is comprised of three points which are respectively one slightly clear point and two normal clear points. This can be further clearly understood by the STM image shown in FIG. 6. When these are compared with the STM image (four leaves mode configuration) of TBPP which is reported in the non-patent literature 3: T. A. Jung, H. R. Schlittler and J. K. Gimzewski, Nature 386 (1997) 696, one leaf among the four leaves mode configuration is lost in the case of MSTBPP. The four leaves mode configuration obtained in the STM observation of the TBPP molecule comes from four di-tert-butylphenyl groups which the TBPP molecule has. Collectively judging the structural difference of the MSTBPP molecule and the TBPP molecule and data that was obtained from the NC-AFM image (which mainly reflects the unevenness in the shape of an observation sample) and the STM image (which mainly reflects the space distribution shape of electron tunneling probability), it can be concluded that the deficit sites in the MSTBPP molecule image that were seen in the image in FIG. 5 come from the methylthiophenyl group. The sites of the methylthiophenyl group always face to the terrace edges, and thus are arranged to be directly brought in contact with the edge wall as shown in FIG. 6. This suggests that the attraction between the MSTBPP molecule and the terrace edges of the substrate is provoked by the methylthiophenyl group. It has been predicted in the study of self-organization film (SAM film) that there is a possibility of exhibiting a powerful attraction on a metal substrate (in particular, a metal plate in many cases), because a portion of a substituent containing a sulfur has a localized non-common electron pair at the site of sulfur. The present confirms this detail at the molecule level and is the first in the world to do so. Further, the primary factor of the attraction interaction which the methylthiophenyl group provided to the host molecule is not diffused over the whole molecule but remains at the sulfur portion of the methylthiophenyl group. This attraction interaction is the support and driving force of the basic mechanism by which the MSTBPP molecule is arranged at the terrace edge lines while keeping regularity at positions relative to the ridges of terrace edges which were formed on the Au substrate as the potential singular points.

Figure 7:
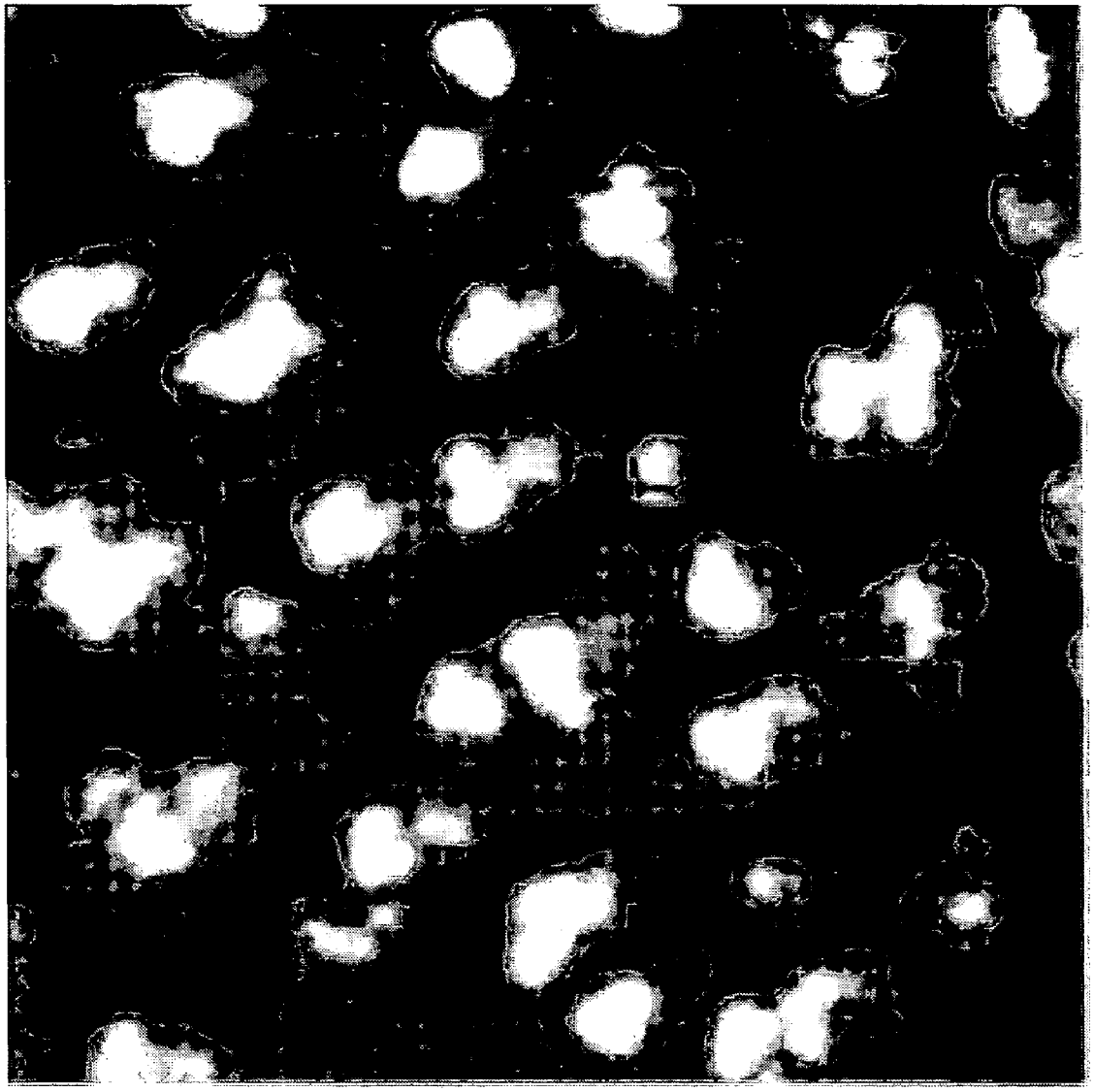
FIG. 7 is an STM photograph of MSTBPP dispersed on the terrace of the Au (111) substrate.

A similar phenomenon is observed for the MSTBPP molecule which was dispersed on the terraces that were formed on the Au (111) plane. Specifically, the phenomenon is seen in the NC-AFM image shown in FIG. 7. In the case of the TBPP molecule, the two dimensional island configuration, in which a great number of molecules were regularly arranged, is observed. (T. Yokoyama, S Yokoyama, T. Kamikado and S. Mashiko, J. Chem. Phys. 115 (2001) 3814). However, in the case of the MSTBPP molecule, the tendency is not observed at all. This fact can be understood by considering the existence of a powerful attraction which is generated between the methylthiophenyl group of MSTBPP and the substrate. The molecules in the molecular beam which were irradiated on the substrate have a given quantity of thermal motion energy just after their landing on the substrate. Then, the molecules discharge thermal motion energy while freely moving on the substrate for a while, as the thermal motion energy is exhausted, the molecules move to sites which are energetically stable. When the attraction between the molecules and the substrate is not stronger than the intermolecular attraction on the same terraces, it is considered that the molecules are adjacently arranged just before termination of the movement, in like manner as the case of TBPP, to form the above-mentioned island configuration. However, since the attraction between the molecules and the substrate is by far stronger than the intermolecular attraction on the same terraces in the case of the MSTBPP molecule, each of the molecules exhausts adequately the motion energy when some potential singular points exist on the surfaces of terraces, and are adsorbed on the surfaces before forming islands. As a result, each of the molecules cannot move freely after the position is fixed on the surface. In this case, it is elucidated that intermolecular interaction slightly influences the arrangement of relative mode. therefore the formation of the island configuration does not occur.

Figure 8:
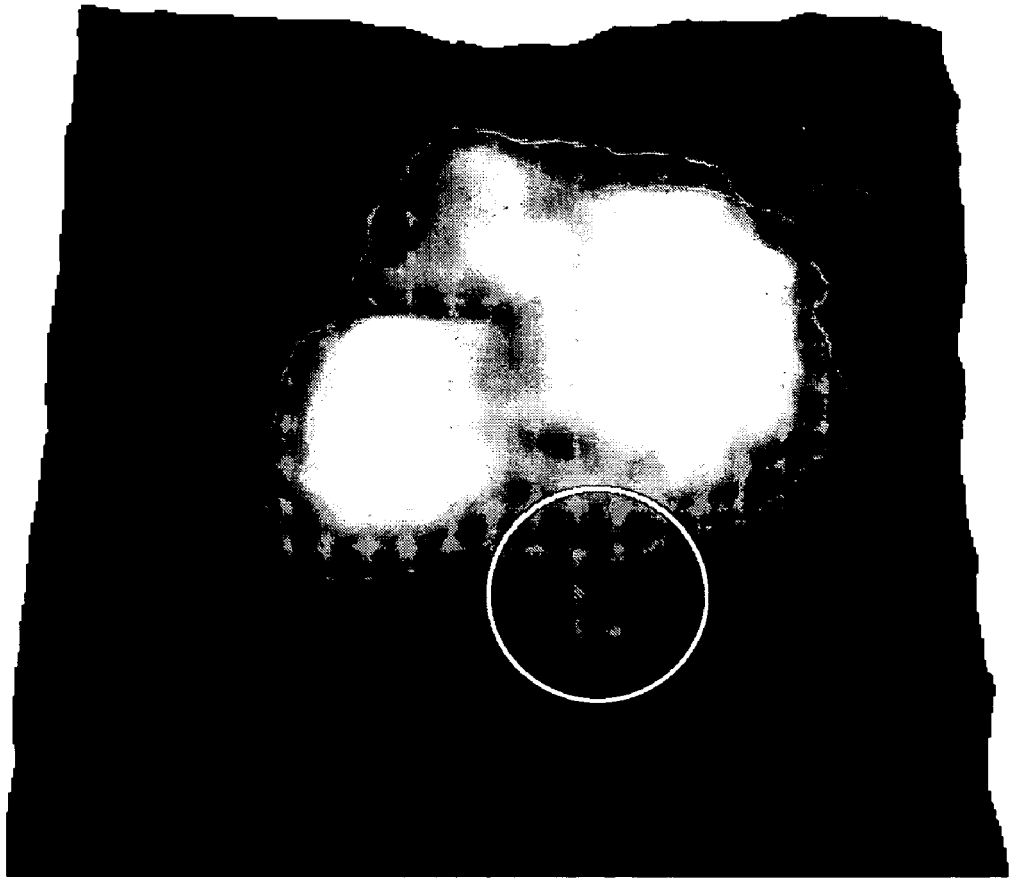
FIG. 8 is a three dimensional image of a molecule obtained from FIG. 7.

The three dimensional image of a MSTBPP molecule which was arranged on the terrace is shown in FIG. 8. The molecular image is constituted by three large brilliant points and one small brilliant point. Collecting the experimental facts hitherto, it can be concluded that the portion shown with a white circle in the drawing is the methylthiophenyl group. In this case, the brilliant portion that is situated at the counter side of the methylthiophenyl group molecule against molecular center is the leg of di-tert-butylphenyl. The portion is observed slightly dark in comparison with the adjacent two brilliant points. The difference means that the planar shape of the MSTBPP molecule is slightly warped on the terrace. It is elucidated that the methylthiophenyl group is attracted to the substrate plane by the attraction interaction which is generated between the methylthiophenyl group and the Au (111) plane therefore an asymmetric force was generated in the molecule. This illustrates that even if the molecule exists on the terrace, the primary factor of the attraction interaction which the methylthiophenyl group provided to the host molecule is not diffused over the whole molecule but remains at the sulfur portion of the methylthiophenyl group, and it can be applied as the mechanism controlling the potential singular points on the Au substrate and the relative positional relation of the molecule.

As described above, the configuration and the mode of MSTBPP which was deposited on the Au (111) finely slant substrate were studied using STM and NC-AFM. There was obtained an image having adequate resolution for elucidating the specific arrangement situation and configuration of MSTBPP. It was clarified that the methylthiophenyl group of the molecule expresses the selective attraction interaction against the potential singular points formed on the Au (111) substrate. It was clarified that the site expressing the force is not dispersed over the whole host molecule but remains localized at the sulfur portion of the methylthiophenyl group which was bonded with the molecule and controls the relative mode of the molecule against the substrate. Thus, it was clarified that the methylthio group (methylthiophenyl group) of the porphyrin derivative having a methylthio group (methylthiophenyl group) in the molecule is selectively and strongly interacted with points in which potential is different from the surrounding area such as a rim portion of a metal substrate, and controls the relative positional relation of the molecule against the potential singular points on the substrate.

According to the present invention, there can be controlled the conformation at a molecular level and chemical reactions at a molecular level that could not heretofore be controlled. Accordingly, the present invention can be applied for a novel chemical reaction in which the reaction is controlled at a molecular level.

According to the present invention, the molecular device with correct regularity which controlled the reaction position can be produced. Accordingly, the present invention can be applied for a process for producing a bottom-up type nano-device wherein the space position is controlled at a molecular level.

According to the present invention, since the nano-device wherein the space position is controlled at a molecular level can be provided, it can provide not only a new material and a new device, but also can be applied to various technical fields such as optical information, information technology, electronic and electric technology, medical equipments, bio technology and environmental repairing.

What is claimed is:

1. A process for producing a nano-device comprising:

a step for intentionally forming a pattern of a plurality of potential singular points on a substrate having a surface roughness of 1 nm or less;

wherein the potential singular points are recess points on the substrate formed by using one or more of the group consisting of an electron beam, a convergent atomic beam, a convergent ion beam, or nanolithography, and said pattern is formed by controlling the interval and position at which each of the recess points are provided;

a contacting step for contacting and bonding first compounds with the potential singular points, each of the first compounds having one or more functional groups; and a step for bonding the first compounds with second compounds after the first compounds bond with the substrate via the potential singular points, each of the second compounds being capable of bonding at least one of the first compounds, wherein the first compounds are different from the second compounds and a plurality of first compounds are bonded to a single second compound, wherein the first compounds and the second compounds constitutes the nano-device, wherein the one or more functional groups interacts with the potential singular points, and wherein the step for forming potential singular points controls the positions of the potential singular points so that the space positions of the first compounds are controlled wherein each of said first compounds having one or more functional groups is a porphyrin compound denoted by the following General Formula (I):

(I)

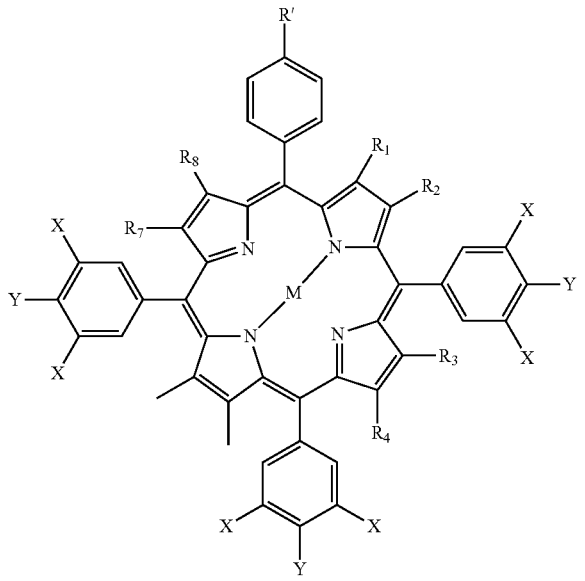

wherein M is one selected from the group consisting of two hydrogen atoms, a divalent metal, a trivalent metal derivative, or a tetravalent metal derivative;

R' is one selected from the group consisting of an alkenyl group of 2 to 12 carbon atoms, an alkenyloxy group of 2 to 12 carbon atoms, a dienyl group of 3 to 6 carbon atoms, an alkynyl group of 2 to 12 carbon atoms, an alkynyloxy group of 2 to 12 carbon atoms, a hydroxyl group, an alkoxy group of 1 to 12 carbon atoms, an acyl group of 1 to 12 carbon atoms, an acyloxy group of 1 to 30 carbon atoms, a carboxyl group, an alkoxycarbonyl group of 1 to 12 carbon atoms, a carbamoyl group, an alkylcarbamoyl group of 1 to 12 carbon atoms, an amino group, an alkylamino group of 1 to 12 carbon atoms, an arylamino group, a cyano group, an isocyano group, an acylamino group of 1 to 12 carbon atoms, a nitroso group, a nitro group, a mercapto group, an alkylthio group of 1 to 12 carbon atoms, a sulfo group, a sulfino group, an alkylsulfonyl group of 1 to 12 carbon atoms, a thiocyanato group, an isothiocyanato group, a thiocarbonyl group, a sulfamoyl group, an alkylsulfamoyl group of 1 to 12 carbon atoms, a hydroxyiminomethyl group (—CH═NOH), an alkoxyiminomethyl group, an alkenyloxyiminomethyl group of 1 to 12 carbon atoms, an alkynyloxyiminomethyl group of 1 to 12 carbon atoms, an alkyliminomethyl of 1 to 12 carbon atoms, an alkylsulfamoyliminomethyl group of 1 to 12 carbon atoms, a thiocarboxyl group, a hydroxyaminocarbonyl group, an alkoxyaminocarbonyl group, and halogens;

X is one selected from the group consisting of an alkyl group of 1 to 12 carbon atoms, an alkoxy group of 1 to 12 carbon atoms, a trialkylsilyloxy group, a phenyldialkylsilyloxy group, and an alkyldiphenylsilyloxy group;

Y is one selected from the group consisting of a hydrogen atom, a hydroxyl group, an alkoxy group of 1 to 30 carbon atoms, an alkenyloxy group of 2 to 30 carbon atoms, an alkynyloxy group of 2 to 30 carbon atoms, and an acyloxy group of 1 to 30 carbon atoms;

and $R_5$ to $R_8$ are each independently one of the group consisting of a hydrogen atom, a halogen atom, an amino group, a hydroxyl group, a nitro group, a cyano group, and alkyl groups of 1 to 3 carbon atoms that may have a substituent group.

2. The process for producing a nano-device according to claim 1, wherein the depth of the recess points are 1 to 50 angstroms.

3. The process for producing a nano-device according to claim 1, wherein X in General Formula (I) is a tertiary butyl group.

4. The process for producing a nano-device according to claim 1, wherein M in General Formula (I) is two hydrogen atoms, and R' in General Formula (I) is one selected from the group consisting of an alkylthio group of 1 to 12 carbon atoms, a cyano group, a hydroxyl group, a carboxyl group, an amino group, a formyl group, a carbamoyl group, a nitro group, a hydroxyiminomethyl group (—CH═NOH), an ethynyl group, a hydroxyaminocarbonyl group, and a sulfamoyl group.

5. The process for producing a nano-device according to claim 1, wherein R' is a methylthio group.

6. The process for producing a nano-device according to claim 1, wherein a functional group-bearing compound interacting with the potential singular point is a 5-(4-methylthiophenyl)-10,15,20-tris-(3,5-ditertiarybutylphenyl)porphyrin.

* * * * *